US007179112B1

(12) United States Patent
Berens et al.

(10) Patent No.: US 7,179,112 B1
(45) Date of Patent: Feb. 20, 2007

(54) RETENTION SYSTEM FOR MULTIPLE CONNECTORS

(75) Inventors: Jessica R. Berens, Rochester, MN (US); Jeffrey L. Justin, Oronoco, MN (US); Christopher L. Tuma, Mantorville, MN (US); Martin D. Williams, Tucson, AZ (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/232,055

(22) Filed: Sep. 21, 2005

(51) Int. Cl.
*H01R 13/64* (2006.01)

(52) U.S. Cl. ..... 439/373

(58) Field of Classification Search ..... 439/373, 439/370, 362; 174/67, 50, 66, 53
See application file for complete search history.

(56) References Cited

U.S. PATENT DOCUMENTS 2,266,560 A * 12/1941 Mansfield ..... 439/368
2,399,644 A * 5/1946 Lachance ..... 439/362
2,569,037 A * 9/1951 Dalton ..... 439/368
2,595,949 A * 5/1952 Karlsson ..... 200/50.29
4,424,407 A * 1/1984 Barbic ..... 174/67
4,789,353 A * 12/1988 Busta et al. ..... 439/373

* cited by examiner

*Primary Examiner*—Gary F. Paumen
(74) *Attorney, Agent, or Firm*—Quarles & Brady Streich Lang LLP

(57) ABSTRACT

A retention system includes a retainer having at least two wings affixed to a mounting surface by a retaining screw or like attachment device inserted into a hole of the mounting surface. A coil spring or the like, optionally captured by the retaining screw, provides tension between the retainer and the mounting surface. The hole of the mounting surface defines the potential placement of the retainer relative to the mounting surface, allowing it to assume a neutral position and a plurality of offset positions. While in its neutral position, the wings of the retainer prevent the removal of connectors, cables, screws, or other retention devices by physically trapping them between the retainer and the mounting surface. By moving the retainer to one of the plurality of offset positions, a user may expose one of the connectors, cables, screws, or other retention devices, allowing it to be removed while preventing the accidental or inadvertent removal of the other components still trapped by the retainer.

17 Claims, 7 Drawing Sheets

RETENTION SYSTEM FOR MULTIPLE CONNECTORS

BACKGROUND OF THE INVENTION

1. Field of the Invention

This invention is related in general to the field of data management systems. In particular, the invention consists of a system for retaining at least one of a plurality of connectors or cables while allowing a user to remove one or more of the other connectors or cables.

2. Description of the Prior Art

Data management systems are used for providing cost effective storage and retrieval of large quantities of data. In a data management system, data is transmitted over communication channels usually including cables. These cables, in turn, traditionally include connectors for connecting the cables to transmission or receiving devices. The point at which connectors are connected to transmission and receiving devices is often referred to as a buss bar.

Some data management systems are intended to be fully redundant, i.e., each primary component has a backup device which performs the function of the primary component in the event the primary component is damaged, disabled, inoperative, disconnected, or removed from the data management system. Of primary concern is the potential for removing data cables, power cables, or the like, by accident or otherwise. If a user were to disconnect either a primary communication cable or a backup communication cable while the other is also disconnected, the data management system's redundancy would be defeated. Likewise, if a primary or backup power connection is removed while the other is not coupled to the data management system, a catastrophic failure could occur to the data management system that could disrupt the flow of data between the systems components or between the data management system and other extrinsic systems. Additionally, the removal of power from a redundantly designed data management system could result in the loss of data or damage to the system's components.

One approach to this problem has been to physically secure connectors to buss bars or the like by manually inserting a screw through the connector and buss bar. In order to remove such a connector, the user would need to locate an appropriate tool and then remove the screw. This approach helps prevent inadvertent removal of a connector by careless pulling or pushing on other components. Additionally, because a tool is necessary to remove the connector, the user is usually afforded an opportunity to contemplate whether he actually wishes to remove the instant component. Cables can be similarly secured by passing a screw through a retaining clip and buss bar with the same result.

A problem with this approach is that the requirement for a tool may prevent the desired removal of a connector or cable when an appropriate tool cannot be located. Accordingly, it is desirable to have a method for retaining both connectors and cables that prevent their inadvertent removal and gives pause to the user while allowing him to remove either a primary or backup connector or cable without the use of a tool.

As indicated, the failure scenarios discussed above occur due to the inadvertent disconnection of primary and backup connectors or cables. This may also happen if the user is unaware that one of the connectors/cables has already been removed. Accordingly, it is desirable to have a system for retaining primary and backup connectors or cables that can be used to readily ascertain that both the primary and backup components are either both currently present or that only one of the components has already been removed. Additionally, it is desirable to have a system that is easy to use, can allow the quick removal of a connector or cable without the need for tools, and can be used in ubiquitous locations, not just at buss bars or the like.

SUMMARY OF THE INVENTION

The invention disclosed herein utilizes a retainer having two wings attached to a buss bar via a screw and optional one or more placement studs. A spring is placed between the buss bar and the retainer or is captured by the screw to provide tension. In one example of the invention, the screw may be inserted through a coil spring, through a slot in the buss bar, and into the retainer. Or, the screw may be inserted through the slot, through the coil spring, and into the retainer.

The invention disclosed herein is not limited to the use of a screw. Any means for attaching the retainer to the buss bar may be utilized so long as a portion passes through the slot in the buss bar, allowing the user to displace the retainer along the buss bar in an area defined by the slot. Examples of other means for attaching the retainer to the buss bar include using bolts inserted into holes in the retainer, bolts attached to the retainer secured by a nut, a post affixed to the retainer which is inserted through the slot and then enlarged to prevent it from being pulled back through, and a split post having two leafs which is affixed to the retainer, inserted through the slot, and then separated or butterflied away from each other.

As indicated here, the spring may be a coil spring captured by the screw or other attachment device. Alternatively, other types of springs, such as leaf springs which are attached to either the retainer or buss bar without being captured by the screw, may be used to provide tension between the retainer and buss bar.

The one or more placement studs slip into recesses or holes in the buss bar, providing a neutral position. The spring provides tension to keep the retainer in this neutral position until displaced by a user. In this neutral position, the retainer is adapted to prevent the removal of two or more connectors or cables. This is accomplished by utilizing the wings of the retainer to physically trap the connectors or cables. If the user desires to remove either the primary or the backup connector or cable, he simply pulls the retainer away from the buss bar, increasing the tension of the spring, and displaces the placement studs from their recesses or holes. This allows the user to simply slide the retainer along the path defined by the slot, exposing one of the associated connectors or cables.

The invention as described is not limited to securing connectors to buss bars. The same device may be used to secure connector to any component of any device, so long as sufficient space is available to place the desired slot. Also, the same device may be used to secure multiple cables to the buss bar or just about at any location suitable for placing the slot and mounting the retainer. Also, the invention may be used to prevent the accidental removal of screws or like attachment devices by physically trapping them with the retainer's wings.

Various other purposes and advantages of the invention will become clear from its description in the specification that follows and from the novel features particularly pointed out in the appended claims. Therefore, to the accomplishment of the objectives described above, this invention comprises the features hereinafter illustrated in the drawings, fully described in the detailed description of the preferred embodiments and particularly pointed out in the claims. However, such drawings and description disclose just a few of the various ways in which the invention may be practiced.

DESCRIPTION OF THE PREFERRED EMBODIMENTS

This invention is based on the idea of utilizing a retainer with a plurality of wings attached to buss bar or similar surface by way of a screw, bolt, or other similar attachment device inserted through a slot in the buss bar or similar surface, wherein the slot defines an allowable path for the retainer. A spring may be used to provide tension between the retainer and buss bar. Optional placement studs may be inserted into placement holes or recesses within the buss bar to define a neutral position. The plurality of wings prevent the removal of connectors, cables, screws, or other retention devices by physically trapping them while the retainer is in its neutral position. By moving the retainer from its neutral position, one of the connectors, cables, screws, or other retention devices is exposed, allowing it to be removed while still trapping the others.

Figure 1:
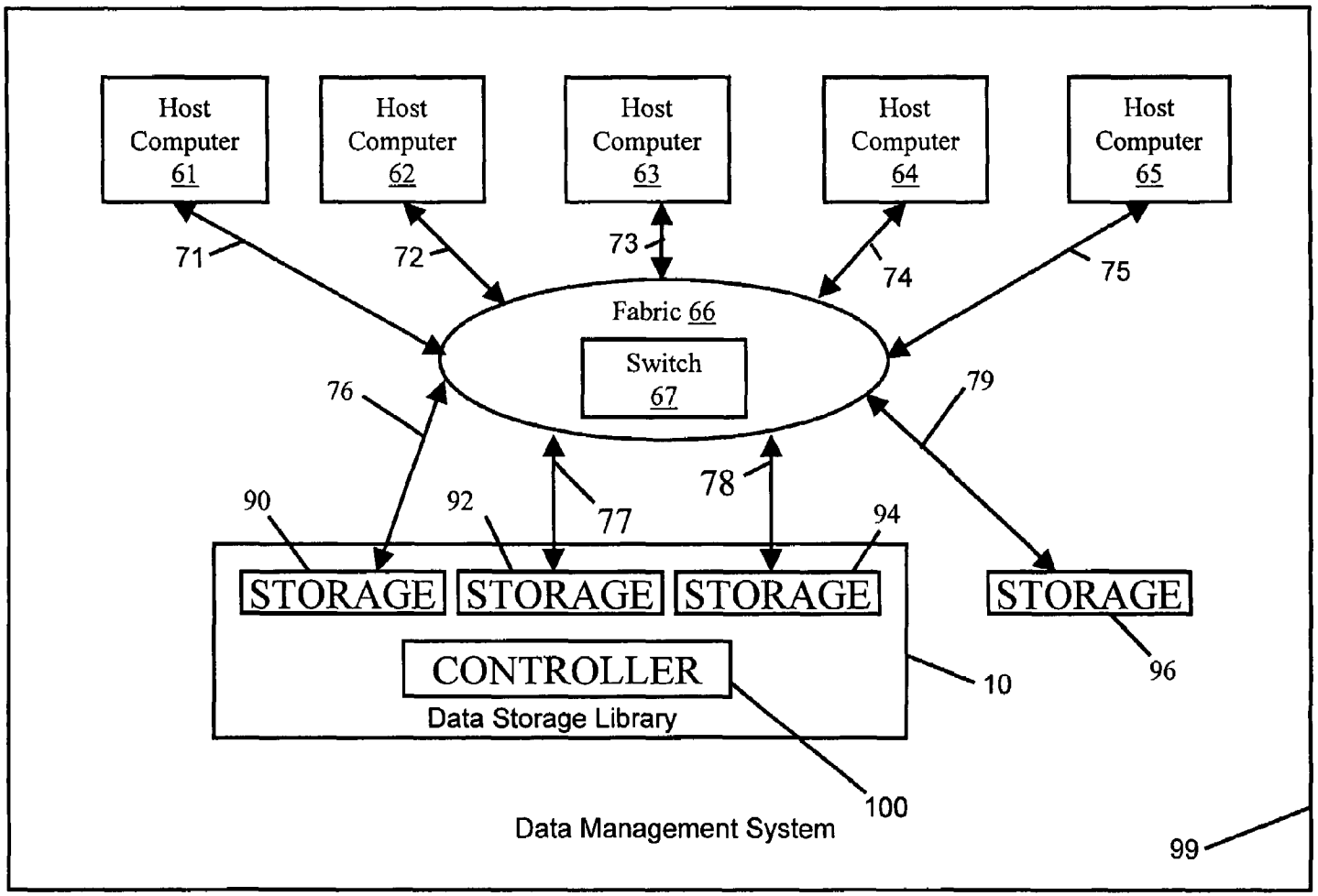
FIG. 1 (PRIOR ART)
FIG. 1 is a block diagram illustrating a data storage system including a data management system that may utilize the present invention.

Referring to figures, wherein like parts are designated with the same reference numerals and symbols, FIG. 1 is a block diagram that illustrates aspects of an exemplary data management system 99, according to one embodiment of the present invention. The data management system 99 is designed as a switched-access-network, wherein switches 67 are used to create a switching fabric 66. In this embodiment of the invention, the data storage system 99 is implemented using Small Computer Systems Interface (SCSI) protocol running over a Fibre Channel ("FC") physical layer. However, the data management system 99 could be implemented utilizing other protocols, such as Infiniband, FICON, TCP/IP, Ethernet, Gigabit Ethernet, or iSCSI. The switches 67 have the addresses of both the hosts 61, 62, 63, 64, 65 and storage units 90, 92, 94, 96.

Host computers 61, 62, 63, 64, 65 are connected to the fabric 66 utilizing I/O interfaces 71, 72, 73, 74, 75 respectively to fabric 66. I/O interfaces 71–75 may be any type of I/O interface; for example, a FC loop, a direct attachment to fabric 66 or one or more signal lines used by host computers 71–75 to transfer information respectfully to and from fabric 66. Fabric 66 includes, for example, one or more FC switches 67 used to connect two or more computer networks. In one embodiment, FC switch 67 is a conventional router switch.

Switch 67 interconnects host computers 61–65 to storage 90, 92, 94, and 96 across respective I/O interfaces 76–79. I/O interfaces 76–79 may be any type of I/O interface, for example, a Fibre Channel, Infiniband, Gigabit Ethernet, Ethernet, TCP/IP, iSCSI, SCSI I/O interface or one or more signal lines used by FC switch 67 to transfer information respectfully to and from storage 90, 92, 94, and 96. In the example shown in FIG. 1, storage 90, 92, and 94 are stored within data storage library 98, and storage 96 is network attached storage ("NAS").

A data storage library 10 typically includes one or more controllers 100 to direct the operation of the library. The controller may take many different forms and may include an embedded system, a distributed control system, a personal computer, workstation, etc.

Figure 2:
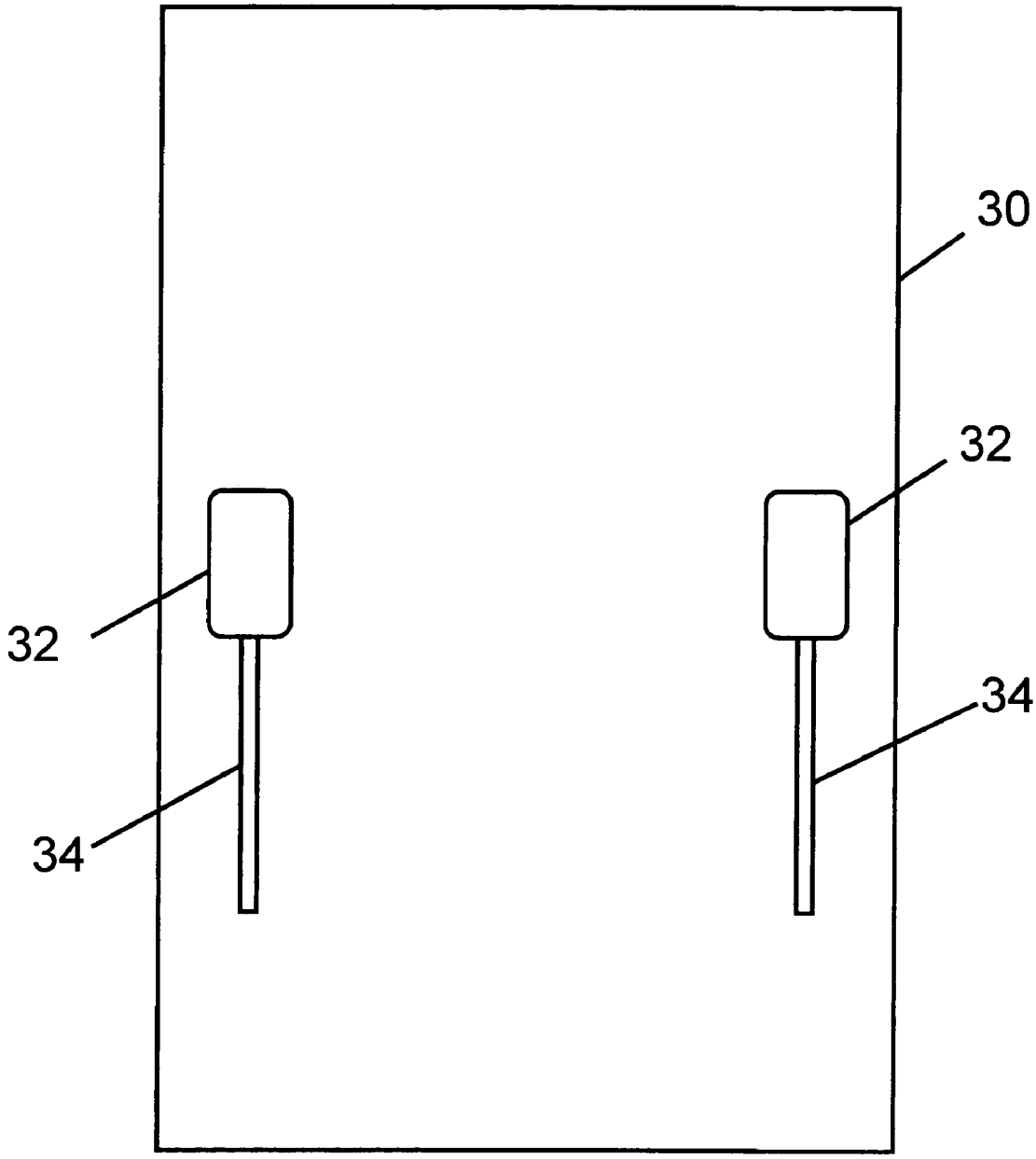
FIG. 2 (PRIOR ART)
FIG. 2 is a block diagram of a buss bar containing a first and second cable with their attendant connectors, as is known in the art.

FIG. 2 illustrates, in a block diagram, a buss bar 30. Here, two connectors 32 are used to removably attach the cables 34 to the buss bar. The cables 34 may be used to transfer data between components of the data management system 10, such as between the storage devices 90 and the fabric 66. Likewise, the cables 34 may be used to provide power to a component, such as the controller 100 of the data storage library 10. The cables 34 and their attendant connectors 32 may include a primary and a backup component. Or, the two cables may simply be any two components that a user wishes to selectively limit the removal thereof.

Here, the exemplary invention includes a buss bar 30, which is a common location for attaching cables to a component. However, the invention may be utilized on almost any surface to which multiple cables, connectors, screws, or other retention devices are attached.

Figure 3:
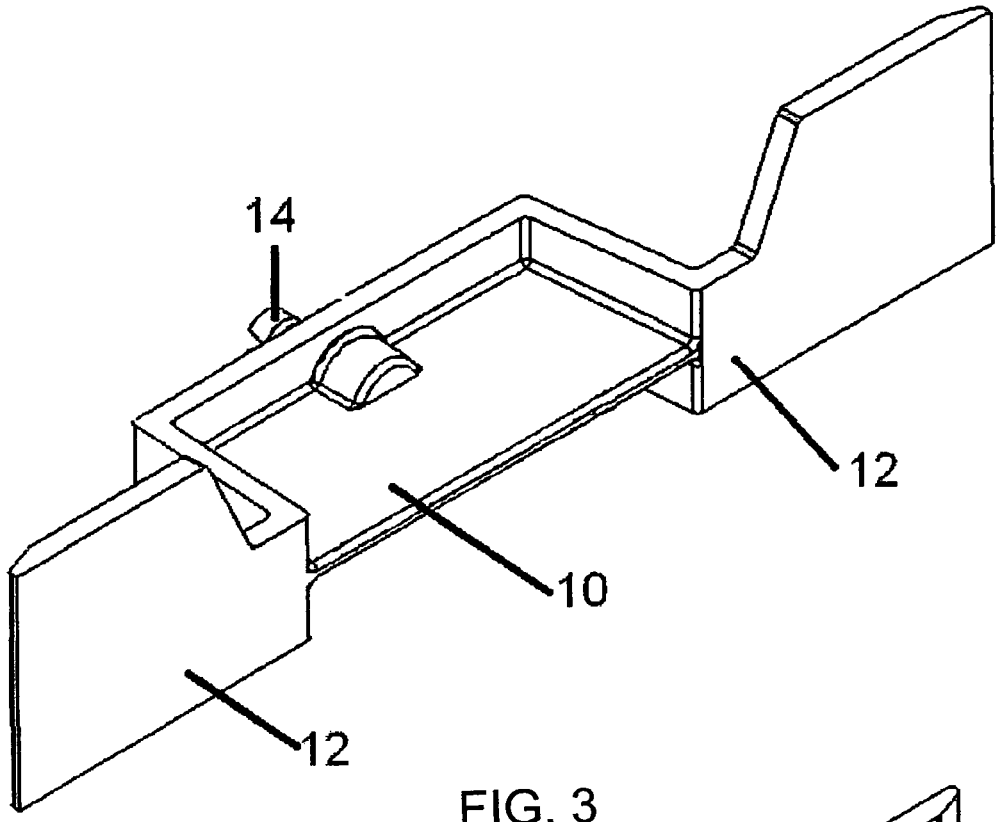
FIG. 3 is front isometric view of a retainer including a pair of wings, according to the invention.

An exemplary embodiment of a retainer 10 is illustrated in the isometric drawing of FIG. 3, including a pair of wings 12 and a retaining screw 14. This retainer 10 is more fully illustrated in the drawing of FIG. 4. Here, a coil spring 16 is captured by the retaining screw 14. Optional placement studs 18 are also included.

Figure 4:
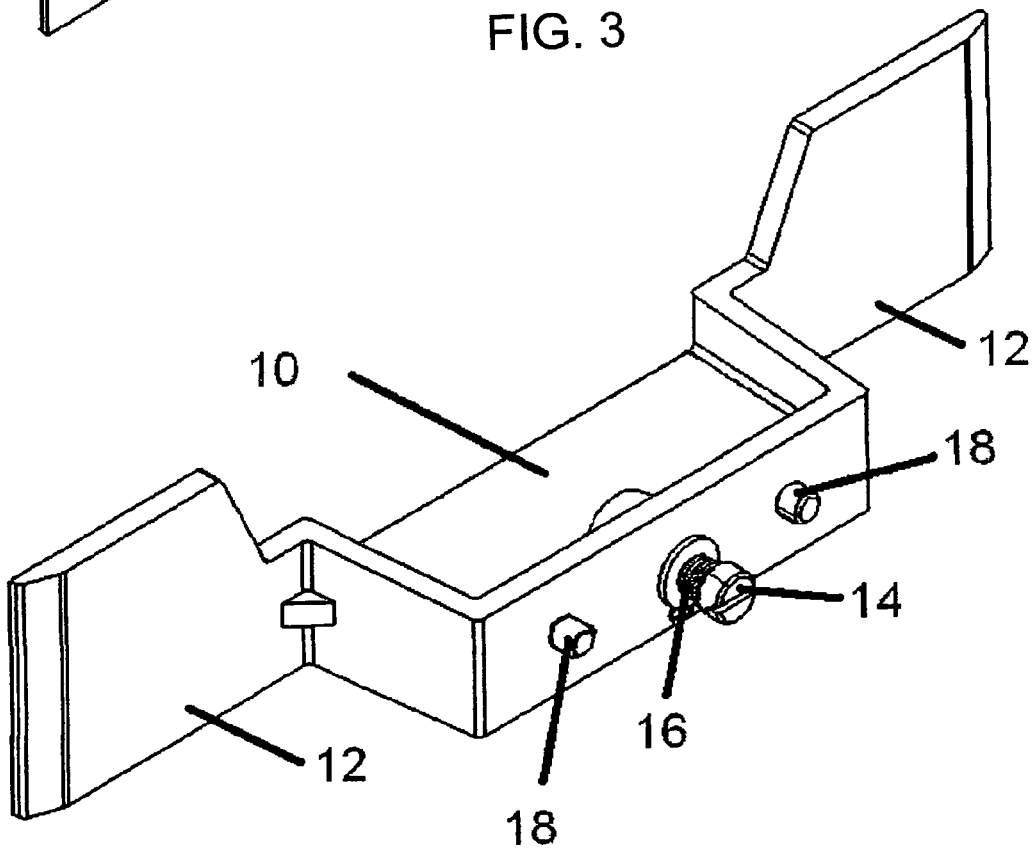
FIG. 4 is a rear isometric view of the retainer of FIG. 3, including a coil spring, a retaining screw, and optional placement studs, according to the invention.
Figure 5:
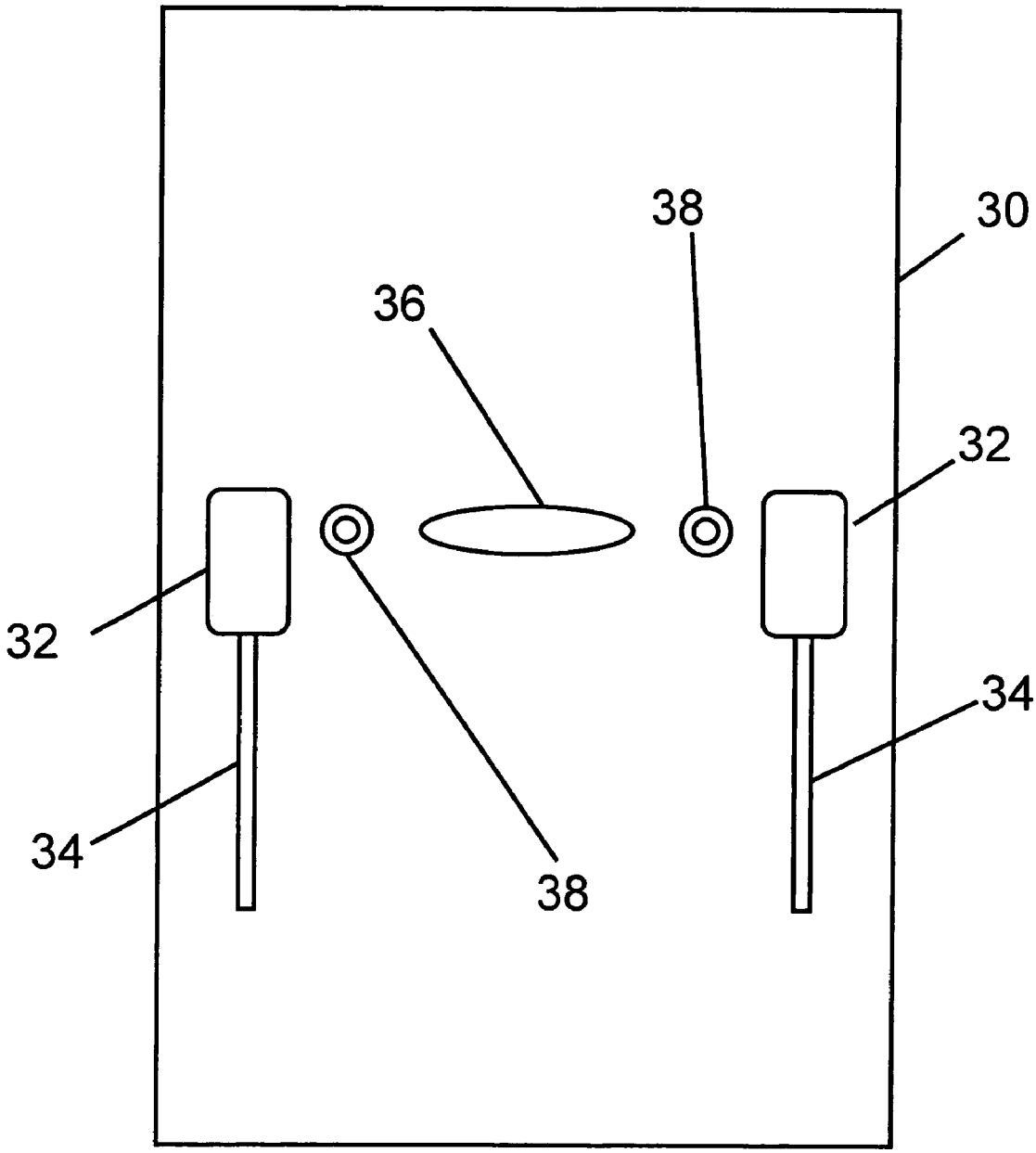
FIG. 5 is a block diagram of the buss bar of FIG. 2, modified according to the present invention to include a slot and optional placement holes.

FIG. 5 illustrates the buss bar 30 of FIG. 2, which has been modified to include a slot 36 and placement holes 38. The retaining screw of FIGS. 3 and 4 is intended to pass through the spring 16, through the slot 36, and into the retainer 10, removably affixing the retainer to the buss bar.

The spring 16, as illustrated, is not a necessary component of the invention, and may be omitted. The tension that would have been provided by the spring 16 may be provided by sufficiently tightening retaining screw 14. As the slot 36 defines the possible locations of the retainer by limiting the position of the retaining screw 14, a user may simply pull the retainer away from the surface of the buss bar 30 and move the retainer 10 to a different location on the buss bar 30. This procedure is simplified and facilitated by the inclusion of the spring 16, but may be performed by simply loosening the retaining screw. An oversized head on the retaining screw 14 may be provided to allow the user to tighten and loosen the retaining screw without the need for a tool.

The optional placement holes 38 are intended to receive the optional placement studs (18) introduced in FIG. 4. This provides a neutral position for the placement of the retainer 10.

Figure 6:
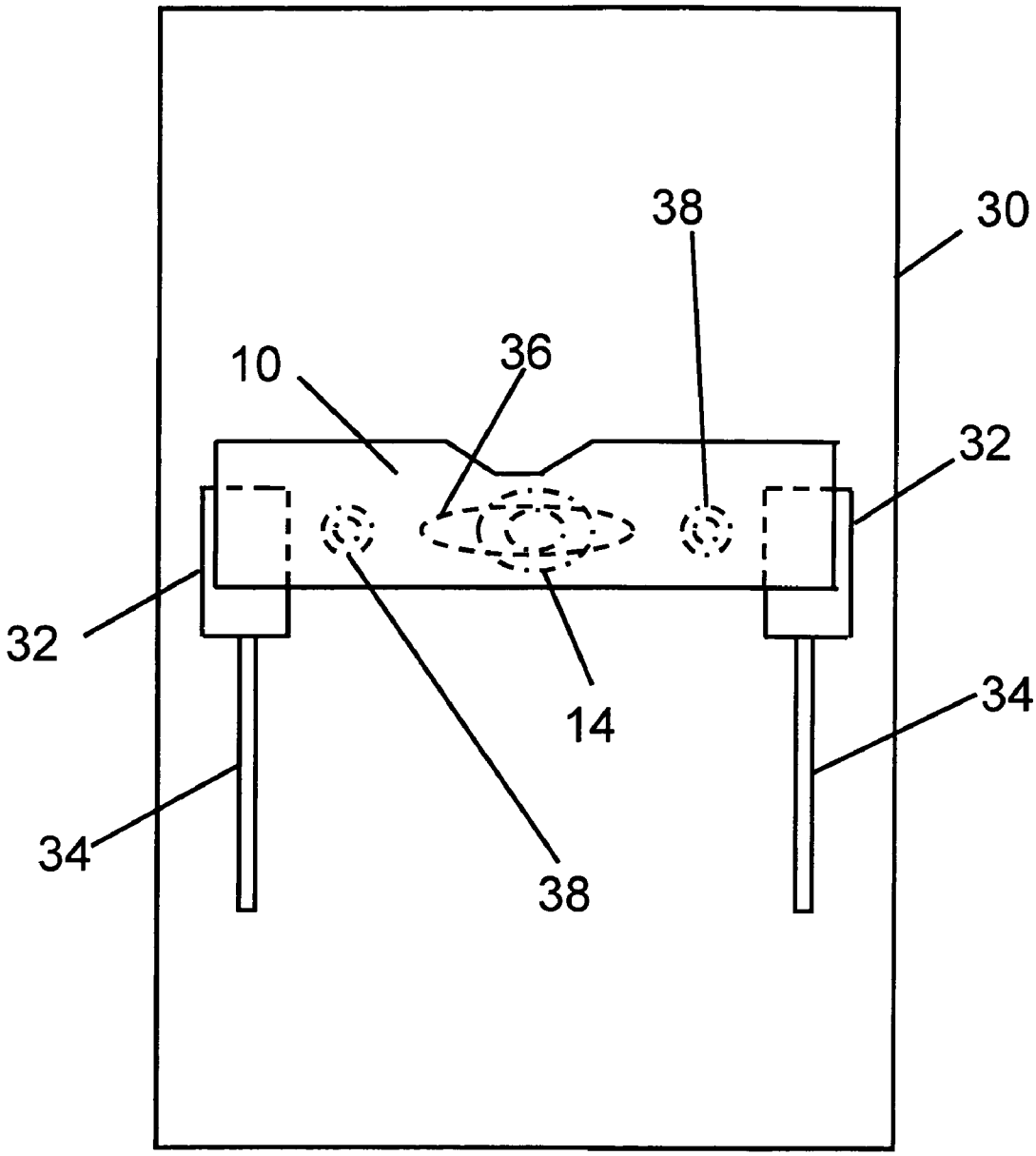
FIG. 6 is a block diagram of the buss bar of FIG. 5, including a retainer attached to the buss bar to retain the connectors, according to the invention.

In FIG. 6, the retainer of FIGS. 3 and 4 and has been removably affixed to the buss bar, as described above. In the neutral position, the retainer prevents the removal of the connectors 32 by physically trapping them with its wings 12. If the user desires to remove either the primary or the backup connector or cable, he simply pulls the retainer away from the buss bar, increasing the tension of the spring, and displaces the placement studs from their recesses or holes. This allows the user to simply slide the retainer along the path defined by the slot, exposing one of the associated connectors or cables.

Figure 7:
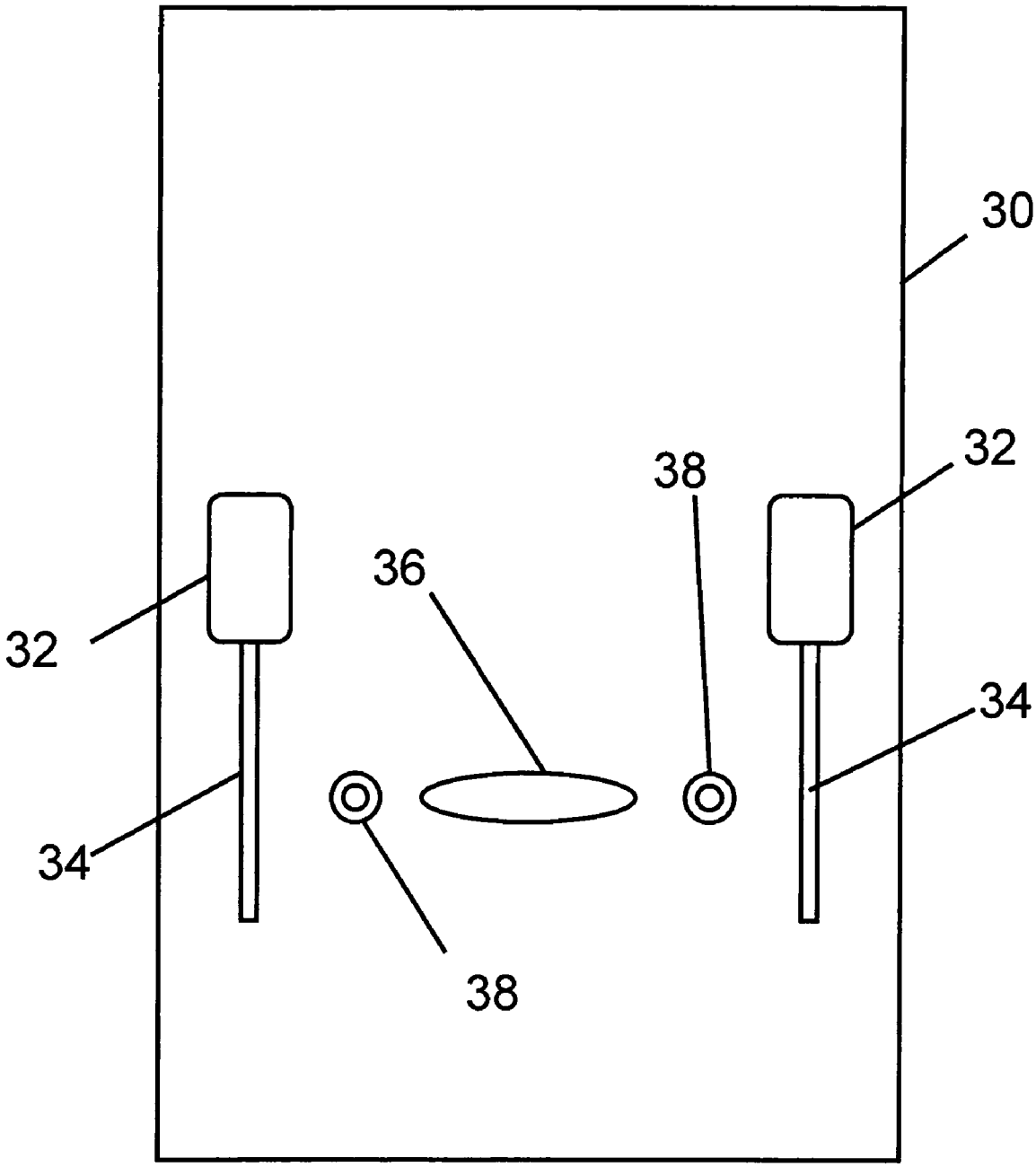
FIG. 7 is a block diagram of the buss bar of FIG. 5, wherein the slot and optional placement holes have been positioned adjacent to the first and second cables.
Figure 8:
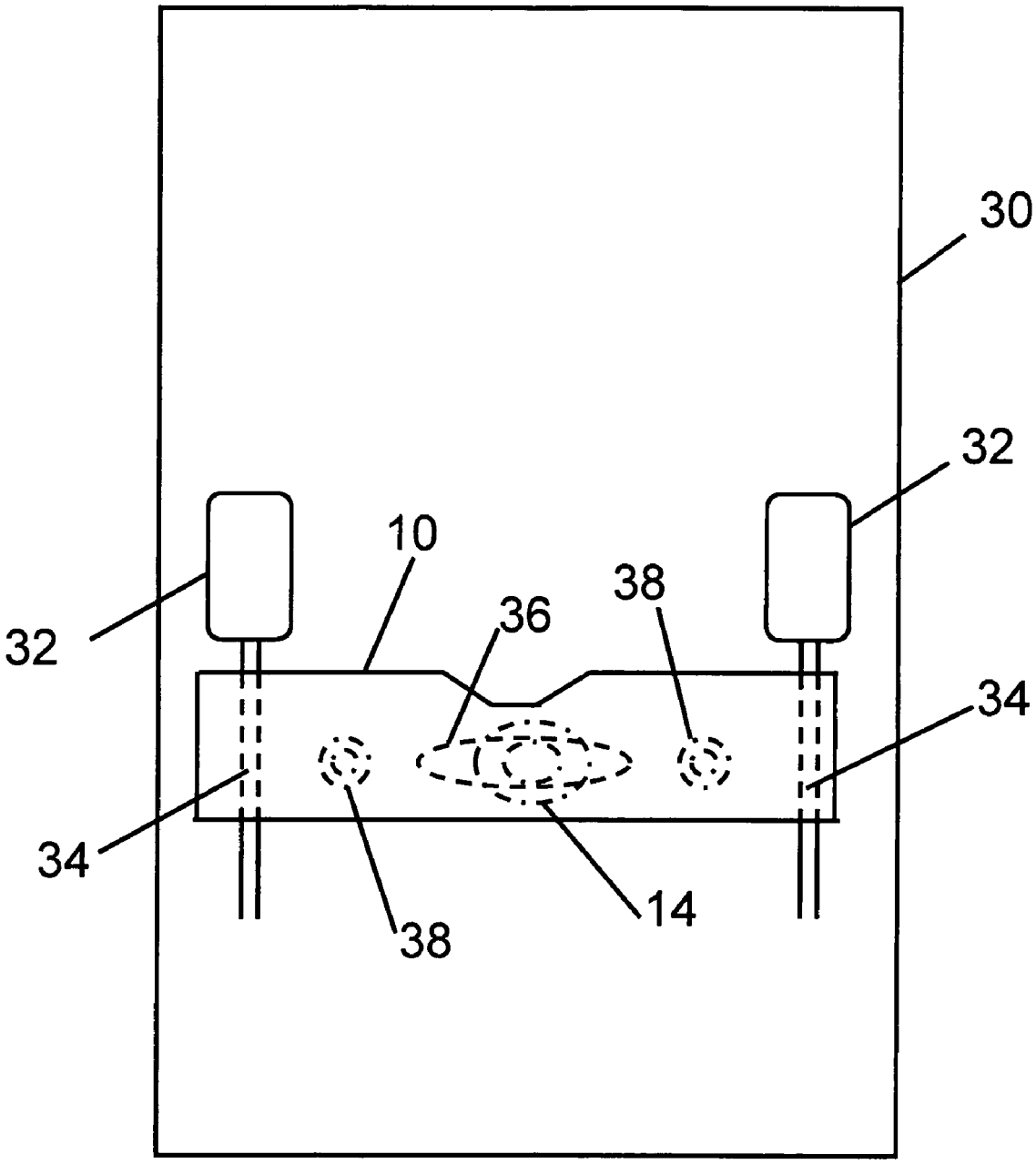
FIG. 8 is a block diagram of the buss bar of FIG. 7, including a retainer.

The block diagram of FIG. 7 illustrates a buss bar 30 similar to that of FIG. 5, with its slot 36 and optional placement holes relocated. In FIG. 8, the retainer is positioned to retain the cables 34, rather than their attendant connectors 32.

In the illustrated example of the invention, the screw may be inserted through a coil spring, through a slot in the buss bar, and into the retainer. Alternatively, the screw may be inserted through the slot, through the coil spring, and into the retainer. However, the invention disclosed herein is not limited to the use of a screw. Any means for attaching the retainer to the buss bar may be utilized so long as a portion passes through the slot in the buss bar, allowing the user to displace the retainer along the buss bar in an area defined by the slot. Examples of other means for attaching the retainer to the buss bar include using bolts insert into holes in the retainer, bolts attached to the retainer secured by a nut, a post affixed to the retainer which is inserted through the slot and then enlarged to prevent it from being pulled back through, and a split post having two leafs which is affixed to the retainer, inserted through the slot, and then separated or butterflied away from each other.

As indicated here, the spring may be a coil spring captured by the screw. Alternatively, other types of springs, such as leaf springs which are attached to either the retainer or buss bar may be used to provide tension between the retainer and buss bar. The springs may or may not be captured by the retaining screw or similar attaching device.

The invention is not limited to securing connectors to buss bars. The same device may be used to secure connectors to any component of any device, so long as sufficient space is available to place the desired slot. Also, the device may be used to secure multiple cables to the buss bar or just about at any location suitable for placing the slot and mounting the retainer. Also, the invention may be used to prevent the accidental removal of screws or like attachment devices by physically trapping them with the retainer's wings.

It should be noted that the invention is not limited to use on flat surfaces. The surface of the buss bar 30 containing the slot 36 may be curved or assume some other non-flat configuration, so long as the shape of the retainer allows it to move over an area defined by the slot 36.

Those skilled in the art of data management systems may develop other embodiments of the present invention. However, the terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

We claim:

1. A retention system, comprising:

a retainer including a first wing and a second wing;

a mounting surface defining a mounting hole there through;

a spring adapted to produce tension between the retainer and the mounting surface; and a retaining device adapted to be inserted through the mounting hole and to affix the retainer to the mounting surface in one of a plurality of positions including a neutral position and a first offset position, wherein the first wing is adapted to retain a first component and the second wing is adapted to retain a second component while the retainer is in the neutral position.

2. The retention system of claim 1, wherein the first component includes a cable.

3. The retention system of claim 1, wherein the first component includes a connector.

4. The retention system of claim 1, wherein the retaining device is a screw.

5. The retention system of claim 1 wherein the first wing is adapted to retain the first component and the second wing is adapted to expose the second component while the retainer is in the first offset position.

6. The retention system of claim 1, wherein the plurality of positions further includes a second offset position and wherein the first wing is adapted to expose the first component and the second wing is adapted to retain the second component while the retainer is in the second offset position.

7. A retainer, comprising:

a retaining device;

a first wing;

a second wing; and a spring, wherein the retainer is adapted to be mounted in one of a plurality of positions to a mounting surface having a hole there through by inserting the retaining device through the hole and attaching it to the retainer, the spring producing tension between the retainer and the mounting surface, wherein the plurality of positions includes a neutral position and a first offset position, and wherein the first wing is adapted to retain a first component and the second wing is adapted to retain a second component while the retainer is in the neutral position.

8. The retainer of claim 7, wherein the first component includes a cable.

9. The retainer of claim 7, wherein the first component includes a connector.

10. The retainer of claim 7, wherein the retaining device is a screw.

11. The retainer of claim 7, wherein the first wing is adapted to retain the first component and the second wing is adapted to expose the second component while the retainer is in the first offset position.

12. The retainer of claim 7, wherein the plurality of positions further includes a second offset position and wherein the first wing is adapted to expose the first component and the second wing is adapted to retain the second component while the retainer is in the second offset position.

13. A retention system, comprising:

a retainer including a first wing, a second wing, and a placement stub;

a mounting surface having a mounting hole, and a placement hole adapted to receive the placement stub while the retainer is in the neutral position; and a retaining device adapted to be inserted through the mounting hole and to affix the retainer to the mounting surface in one of a plurality of positions including a neutral position and a first offset position, wherein the first wing is adapted to retain a first component and the second wing is adapted to retain a second component while the retainer is in the neutral position.

14. The retention system of claim 13, further comprising a spring adapted to produce tension between the retainer and the mounting surface.

15. The retention system of claim 13, wherein the retaining device is a screw.

16. The retention system of claim 13, wherein the first wing is adapted to retain the first component and the second wing is adapted to expose the second component while the retainer is in the first offset position.

17. The retention system of claim 13, wherein the plurality of positions further includes a second offset position and wherein the first wing is adapted to expose the first component and the second wing is adapted to retain the second component while the retainer is in the second offset position.

* * * * *